US009839242B2

(12) United States Patent
Yuasa et al.

(10) Patent No.: US 9,839,242 B2
(45) Date of Patent: Dec. 12, 2017

(54) CLOTHING ARTICLE HAVING CUP PARTS

(71) Applicant: Wacoal Corp., Kyoto-shi, Kyoto (JP)

(72) Inventors: Masaru Yuasa, Kyoto (JP); Megumi Tachiiri, Kyoto (JP); Masumi Fujii, Kyoto (JP); Keiko Masuda, Kyoto (JP)

(73) Assignee: Wacoal Corporation, Kyoto-Shi, Kyoto (JP)

( * ) Notice: Subject to any disclaimer, the term of this patent is extended or adjusted under 35 U.S.C. 154(b) by 166 days.

(21) Appl. No.: 14/779,613

(22) PCT Filed: Mar. 24, 2014

(86) PCT No.: PCT/JP2014/058061

§ 371 (c)(1),
(2) Date: Sep. 24, 2015

(87) PCT Pub. No.: WO2014/157075

PCT Pub. Date: Oct. 2, 2014

(65) Prior Publication Data

US 2016/0044970 A1 Feb. 18, 2016

(30) Foreign Application Priority Data

Mar. 29, 2013 (JP) ..... P2013-073109

(51) Int. Cl.
*A41C 3/00* (2006.01)
*A41C 3/12* (2006.01)

(52) U.S. Cl.
CPC ..... *A41C 3/0007* (2013.01); *A41C 3/0021* (2013.01); *A41C 3/128* (2013.01); *A41C 3/122* (2013.01)

(58) Field of Classification Search
CPC .. A41C 3/00; A41C 3/02; A41C 3/005; A41C 3/0021; A41C 3/12; A41C 3/10
(Continued)

(56) References Cited

U.S. PATENT DOCUMENTS 2,560,706 A * 7/1951 Spetalnik ..... A41C 3/0021 450/65
2,628,357 A 2/1953 Sider
(Continued)

FOREIGN PATENT DOCUMENTS

CN 101389234 A 3/2009
CN 101415345 A 4/2009
(Continued)

OTHER PUBLICATIONS

Chinese Patent Office, Office Action in counterpart Chinese Patent Application No. 201480016882.9, dated Oct. 14, 2016.
(Continued)

*Primary Examiner* — Gloria Hale
(74) *Attorney, Agent, or Firm* — Leydig Voit & Mayer

(57) ABSTRACT

A brassiere according to one embodiment of the present invention is a clothing article having cup parts for covering the breasts, the clothing article having cup hollow parts each of which is provided along a lower edge of the cup part and has a curved shape, the lower edge portion necessitating a small tensile strength for expanding a space between a front center extremity and a side extremity of the curved shape against a retaining force of the lower edge portion of the curved shape; and expansion suppressing parts each of which extends from a front center end to a side end of the lower edge portion along a shape of the cup part in a lower part of the cup part, has a non-stretchable or poorly-stretchable characteristic, and suppresses expansion of the space between the front center extremity and the side extremity of the lower edge portion.

4 Claims, 7 Drawing Sheets

(58) Field of Classification Search
USPC ..... 450/59, 60, 65, 61, 68, 74–76, 44
See application file for complete search history.

(56) References Cited

U.S. PATENT DOCUMENTS

| | | | | | |
|---|---|---|---|---|---|
| 2,773,261 | A * | 12/1956 | Schaum | A41C 3/00 | 450/60 |
| 2,923,301 | A * | 2/1960 | Di Tullio | A41C 3/00 | 450/60 |
| 3,002,516 | A | 10/1961 | Cole | | |
| 4,444,192 | A | 4/1984 | Stern et al. | | |
| 5,660,577 | A * | 8/1997 | Modena | A41C 3/00 | 2/73 |
| 5,823,851 | A * | 10/1998 | Dicker | A41C 3/02 | 2/73 |
| 5,967,877 | A | 10/1999 | Howard | | |
| 8,137,155 | B2 * | 3/2012 | Horii | A41C 3/005 | 450/59 |
| 2004/0110447 | A1 | 6/2004 | Mitchell et al. | | |
| 2005/0079794 | A1 * | 4/2005 | Giese | A41C 3/12 | 450/65 |
| 2007/0298682 | A1 | 12/2007 | Liu | | |
| 2008/0125011 | A1 * | 5/2008 | Gleeson | A41C 3/10 | 450/59 |
| 2011/0130072 | A1 | 6/2011 | Lander | | |

FOREIGN PATENT DOCUMENTS

| | | | |
|---|---|---|---|
| CN | 102112675 | A | 6/2011 |
| CN | 102123619 | A | 7/2011 |
| CN | 102238881 | A | 11/2011 |
| EP | 1 522 227 | A1 | 4/2005 |
| GB | 476038 | A | 11/1937 |
| GB | 1187315 | A | 4/1970 |
| JP | 07-097701 | | 4/1995 |
| JP | 3014318 | U | 8/1995 |
| JP | 2006-063470 | A | 3/2006 |
| JP | 2006-132045 | A | 5/2006 |
| JP | 2011-032591 | A | 2/2011 |
| JP | 2011-236524 | A | 11/2011 |
| JP | 2012-052270 | A | 3/2012 |
| JP | 2012-149373 | A | 8/2012 |
| JP | 2012-162833 | A | 8/2012 |
| WO | WO 2007/080355 | A2 | 7/2007 |
| WO | WO 2011/142284 | A1 | 11/2011 |

OTHER PUBLICATIONS

International Bureau, International Search Report in international application No. PCT/JP2014/058061, dated Apr. 28, 2014.

European Patent Office, extended European Search Report in counterpart European Patent Application No. 14776182.9, dated Oct. 7, 2016.

* cited by examiner

CLOTHING ARTICLE HAVING CUP PARTS

CROSS-REFERENCE TO RELATED APPLICATIONS

The application is the U.S. National Stage of International Application Number PCT/JP2014/058061, filed on Mar. 24, 2014, which claims the benefit of Japanese Patent Application Number P2013-073109, filed on Mar. 29, 2013, which are each incorporated by reference.

TECHNICAL FIELD

The present invention relates to a clothing article having cup parts for covering breasts.

BACKGROUND ART

Patent Literature 1 discloses a brassiere as a clothing article having cup parts for covering the breasts. This brassiere is a brassiere of a non-wire type in which no wire is used in cup hollow parts (cup support parts) provided along the lower edges of the respective cup parts, or, a brassiere of a wire type in which a wire with low rigidity is used in the lower edge portions, which is described as one capable of providing satisfactory wear comfort.

This brassiere is provided with a shape-retaining fabric for three-dimensionally retaining the cup part even when it is not worn. This shape-retaining fabric bridges the back side (skin side) of the cup part, as located afloat from the cup part, so as to pull the front center end and side end of the lower edge portion toward each other, when the brassiere is not worn. The shape-retaining fabric is made of a stretchable material and is described as a fabric that deforms under pressure of the breast when the brassiere is worn and that thus enables the cup part to fit the breast. It is mentioned that this configuration achieves excellent breast shaping capability, while providing satisfactory wear comport.

CITATION LIST

Patent Literature

Patent Literature 1: Japanese Patent Application Laid-open Publication No. 2011-236524

SUMMARY OF INVENTION

Technical Problem

The brassiere described in Patent Literature 1 has a possibility that wearer's motion (e.g., a twist of the upper half of the wearer's body) can cause the cup part and cup hollow part to deviate from the breast (e.g., become afloat) because of insufficient deformation of the shape-retaining fabric.

It is therefore an object of the present invention to provide a clothing article with cup parts capable of achieving satisfactory wear comfort, high following capability to wearer's motion, and high breast shaping capability.

Solution to Problem

A clothing article having cup parts according to the present invention is a clothing article having cup parts for covering breasts, comprising: the lower edge portion each of which is provided along a lower edge of the cup part and has a curved shape, the lower edge portion necessitating a small tensile strength for expanding a space between a front center extremity and a side extremity of the curved shape against a retaining force of the lower edge portion of the curved shape; and expansion suppressing parts each of which extends from a front center end to a side end of the lower edge portion along a shape of the cup part in a lower part of the cup part, has a non-stretchable or poorly-stretchable characteristic, and suppresses expansion of the space between the front center extremity and the side extremity of the lower edge portion. The "small tensile strength" herein refers to a smaller tensile strength necessary for expanding the space between the front center extremity and the side extremity of the curved shape than those in brassieres using commonly-used metal wires, as in non-wire brassieres or brassieres using resin wires.

With this clothing article having the cup parts, the lower edge portion is flexible, easy to expand, and adaptable to a wearer even in motion (e.g., even with a twist of the upper half of the wearer's body) so as to fit well, thereby achieving satisfactory wear comfort.

With this clothing article having the cup parts, the lower edge portion is easy to expand, and thus the lower edge portion and cup part are prevented from deviating from the breast with wearer's motion (e.g., twisting motion of the upper half of the wearer's body). Therefore, it is feasible to enhance the following capability of the lower edge portion and cup part to the breast.

With the clothing article having the cup parts, the expansion suppressing part suppresses the expansion of the lower edge portion, and thus the breast is prevented from being pressed by the upper part of the cup part with the cup part being vertically crushed because of excessive expansion of the lower edge portion. Namely, it can enhance the shape-retaining capability of the cup part. Therefore, it is feasible to enhance the breast shaping capability.

The foregoing expansion suppressing part may be located on a shortest line connecting the front center end and the side end of the lower edge portion, along the shape of the cup part. This can efficiently suppress the expansion of the lower edge portion.

The aforementioned expansion suppressing part may be formed so that the vertical width gradually increases from a front center area to a side area, and may extend from the front center end of the lower edge portion to the side end of the lower edge portion and to a side area of an upper edge of the cup part. This causes the expansion suppressing part to act to lift the breast by making use of a pull-up force of a strap part attached to the side area of the upper edge of the cup part, so that the breast shaping capability can be more enhanced.

The expansion suppressing part may extend along a front surface of the cup part in the lower part of the cup part. This allows us to readily manufacture the expansion suppressing part by a patch or the like on the cup part.

The tensile strength of the foregoing cup hollow part, which is the tensile strength necessary for expanding the space between the front center extremity and the side extremity of the curved shape by 1 cm against the retaining force of the lower edge portion of the curved shape, may be not more than 150 cN. This makes the tensile strength necessary for expanding the space between the front center extremity and the side extremity of the curved shape, smaller than those in the brassieres using commonly-used metal wires, as in the non-wire brassieres or the brassieres using resin wires.

The foregoing cup hollow part may be fitted with a cup wire, the cup wire may have a curved shape, and a tensile strength of the cup wire necessary for expanding a space between a front center extremity and a side extremity of the curved shape by 1 cm against the retaining force of the lower edge portion of the curved shape may be not more than 150 cN.

This configuration makes the cup wire flexible, easy to expand, and adaptable to the wearer even in motion (e.g., even with a twist of the upper half of the wearer's body) so as to fit well, thus achieving satisfactory wear comfort.

Since the cup wire is easy to expand, the cup wire and cup part are prevented from deviating from the breast with wearer's motion (e.g., twisting motion of the upper half of the wearer's body). Therefore, it is feasible to enhance the following capability of the cup wire and cup part to the breast.

Since the expansion suppressing part suppresses the expansion of the cup wire, the breast is prevented from being pressed by the upper part of the cup part with the cup part being vertically crushed because of excessive expansion of the cup wire. Namely, it can enhance the shape-retaining capability of the cup part. Therefore, it is feasible to enhance the breast shaping capability.

The aforementioned cup wire may be comprised of a resin material. The resin wire is more flexible, easier to expand, and more adaptable to the wearer even in motion (e.g., even with a twist of the upper half of the wearer's body) to fit well than the metal wire, and thus it is feasible to achieve satisfactory wear comfort.

Advantageous Effects of Invention

The present invention can achieve the satisfactory wear comfort, high following capability to wearer's motion, and high breast shaping capability.

DESCRIPTION OF EMBODIMENTS

Figure 1:
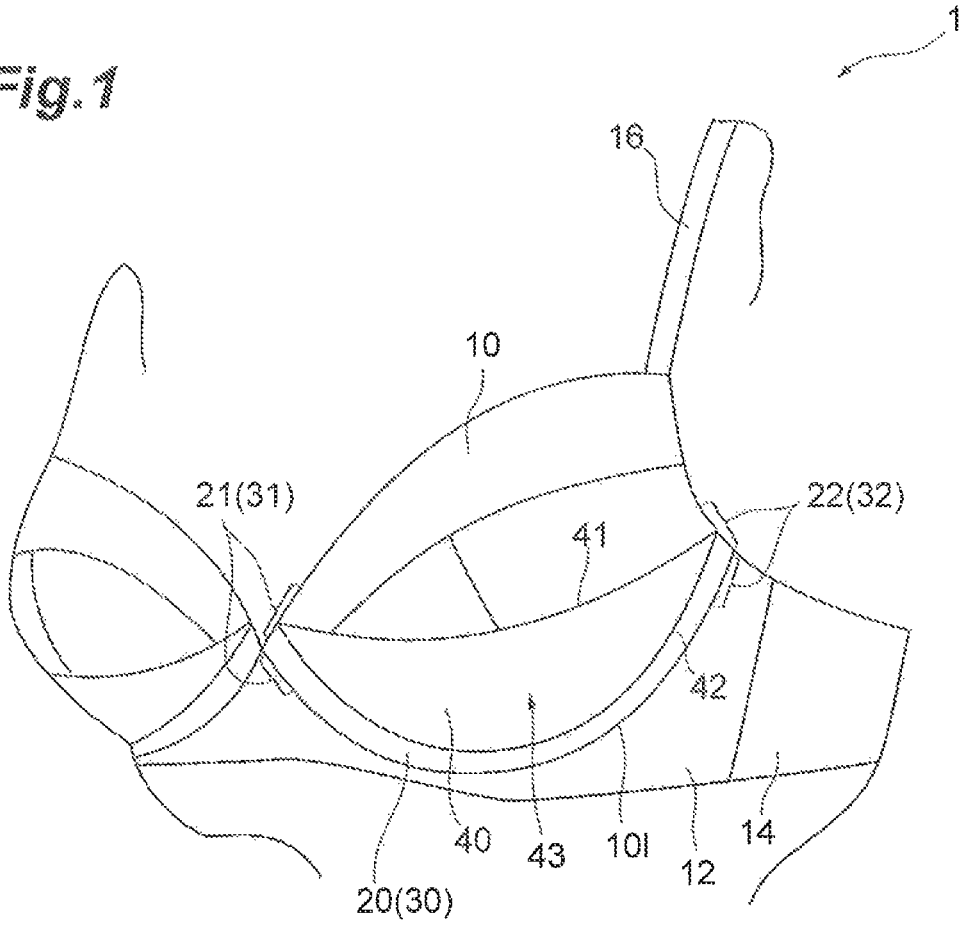
FIG. 1 is a perspective view showing a brassiere according to the first embodiment of the present invention.

The preferred embodiments of the clothing article having the cup parts according to the present invention will be described below in detail with reference to the drawings. In the drawings identical or equivalent portions will be denoted by the same reference signs.

[First Embodiment]

FIG. 1 is a perspective view showing the brassiere according to the first embodiment of the present invention. The brassiere 1 of the first embodiment is provided with cup parts 10, a base part 12, back parts 14, strap parts 16, cup hollow parts 20, cup wires 30, and expansion suppressing parts 40. Since the brassiere 1 is approximately symmetric with respect to the center line, it will be explained below about only one of the right and left halves.

The cup part 10 is a part for covering the breast and is three-dimensionally formed, for example, by joining three pieces of cloth so as to have approximately T-shaped seams (T-shaped three-piece joint cup). The cup part 10 is supported on the base part 12. The base part 12 is made of a non-stretchable fabric and is sewn to a lower edge 101 of the cup part 10. The back part 14 is sewn to a side end of the base part 12. The back part 14 is made of a stretchable fabric and is a part for being coupled to the other back part on the back, thereby supporting the base part 12 and the cup part 10. The strap part 16 is sewn to a side area of an upper edge of the cup part 10. The strap part 16 is made of a stretchable tape material and is a part for being coupled to the back part 14 via the shoulder, thereby supporting the cup part 10.

A bias tape member is sewn along the lower edge 101 of the cup part 10 to the back side (skin side) in a boundary between the cup part 10 and the base part 12, thereby forming the lower edge portion 20. The cup wire 30 is set inside this cup hollow part 20. The expansion suppressing part 40 is provided on the front side of the lower part of the cup part 10. The lower edge portion 20, cup wire 30, and expansion suppressing part 40 will be described below in detail.

The lower edge portion 20 and cup wire 30 have such a curved shape as to extend along the verge's line. The cup wire 30 is relatively flexible (low in rigidity) and the tensile strength necessary for expanding the lower edge portion 20 with the cup wire 30 therein is smaller than those in the brassieres using the commonly-used metal wires, as in the non-wire brassieres and the brassieres using the resin wires. For example, the tensile strength necessary for expanding the cup wire 30 by 1 cm is not more than 150 cN and, as a result, the tensile strength necessary for expanding the lower edge portion 20 with the cup wire 30 therein by 1 cm is also not more than 150 cN. The tensile strength necessary for expanding the lower edge portion 20 or the cup wire 30 by 1 cm herein is the tensile strength necessary for expanding a space between the front center extremity and the side extremity of the curved shape by 1 cm, against a retaining force of the lower edge portion of the curved shape (resilience of the lower edge portion of the curved shape).

For realizing such tensile strength, the cup wire 30 applicable is a rather flexible metal wire, or, a resin wire or the like. The resin wire needs to have some diameter (thickness or width) in view of strength, compared to the metal wire, but it is more flexible, easier to expand, and more adaptable to the wearer even in motion (e.g., a twist of the upper half of the wearer's body) so as to fit well, thus providing satisfactory wear comport. On the other hand, the metal wire has the smaller diameter (thickness or width) to realize the same flexibility, compared to the resin wire, and thus it can realize a better-looking brassiere.

Next, the expansion suppressing part 40 extends from the front center end 21 to the side end 22 of the lower edge portion 20 along the front surface of the cup part 10, in the lower part of the cup part 10. Specifically, an upper edge 41 of the expansion suppressing part 40 is located on the shortest line connecting the front center end 21 and the side end 22 of the lower edge portion 20, on the front surface of the cup part 10, while a lower edge 42 of the expansion suppressing part 40 is located along the lower edge 101 of the cup part 10, i.e., along the lower edge portion 20.

In other words, the expansion suppressing part 40 extends from a front center end 31 to a side end 32 of the cup wire 30. Specifically, the upper edge 41 of the expansion suppressing part 40 is located on the shortest line connecting the front center end 31 and the side end 32 of the cup wire 30, on the front surface of the cup part 10, while the lower edge 42 of the expansion suppressing part 40 is located along the lower edge 101 of the cup part 10, i.e., along the cup wire 30.

The lower edge 42 of the expansion suppressing part 40 is sewn to the cup part 10 and the other region of the expansion suppressing part 40 is not sewn to the cup part 10. The expansion suppressing part 40 is comprised of a non-stretchable or poorly-stretchable member.

This expansion suppressing part 40 functions to suppress expansion of the lower edge portion 20 and the cup wire 30 in such a manner that a center part 43 thereof in contact with the breast bottom serves as a fulcrum, against the expansion of the lower edge portion 20 and the cup wire 30. It should be noted herein that the suppressing force by the expansion suppressing part 40 is not one to suppress expansion required of the lower edge portion 20 and the cup wire 30.

The brassiere 1 of this first embodiment, as described above, is configured with the lower edge portion 20 and the cup wire 30 being flexible, easy to expand, and adaptable to the wearer even in motion (e.g., even with a twist of the upper half of the wearer's body) so as to fit well, thus providing satisfactory wear comfort.

Since the brassiere 1 of the first embodiment has the lower edge portion 20 and cup wire 30 easy to expand, it can suppress deviation of the lower edge portion 20, cup wire 30, and cup part 10 from the breast, with wearer's motion (e.g., twisting motion of the upper half of the wearer's body). Therefore, it can enhance the following capability of the lower edge portion 20, cup wire 30, and cup part 10 to the breast.

Since the brassiere 1 of the first embodiment has the expansion suppressing part 40 to suppress the expansion of the lower edge portion 20 and the cup wire 30, it can prevent the breast from being pressed by the upper part of the cup part 10 with the cup part 10 being vertically crushed because of excessive expansion of the lower edge portion 20 and cup wire 30. Namely, it can enhance the shape-retaining capability of the cup part 10. Therefore, it is feasible to enhance the breast shaping capability.

[Modification Examples of First Embodiment]

Figure 2:
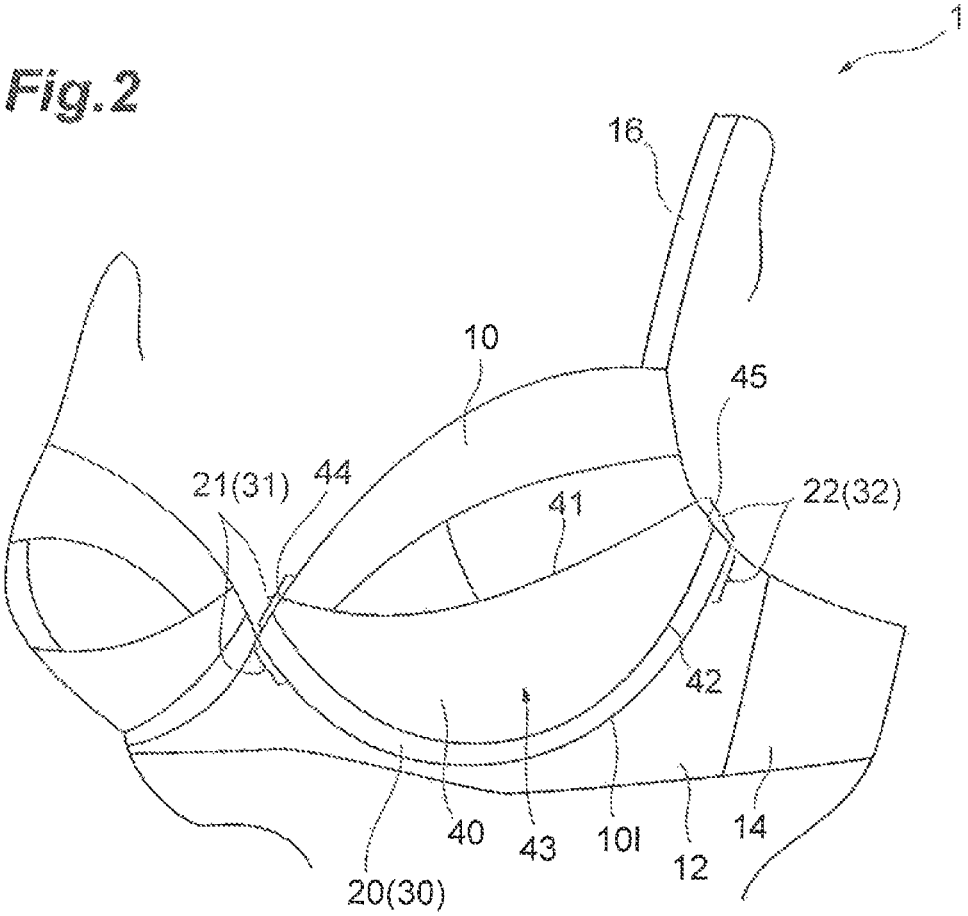
FIG. 2 is a perspective view showing a brassiere according to a modification example of the first embodiment.
Figure 3:
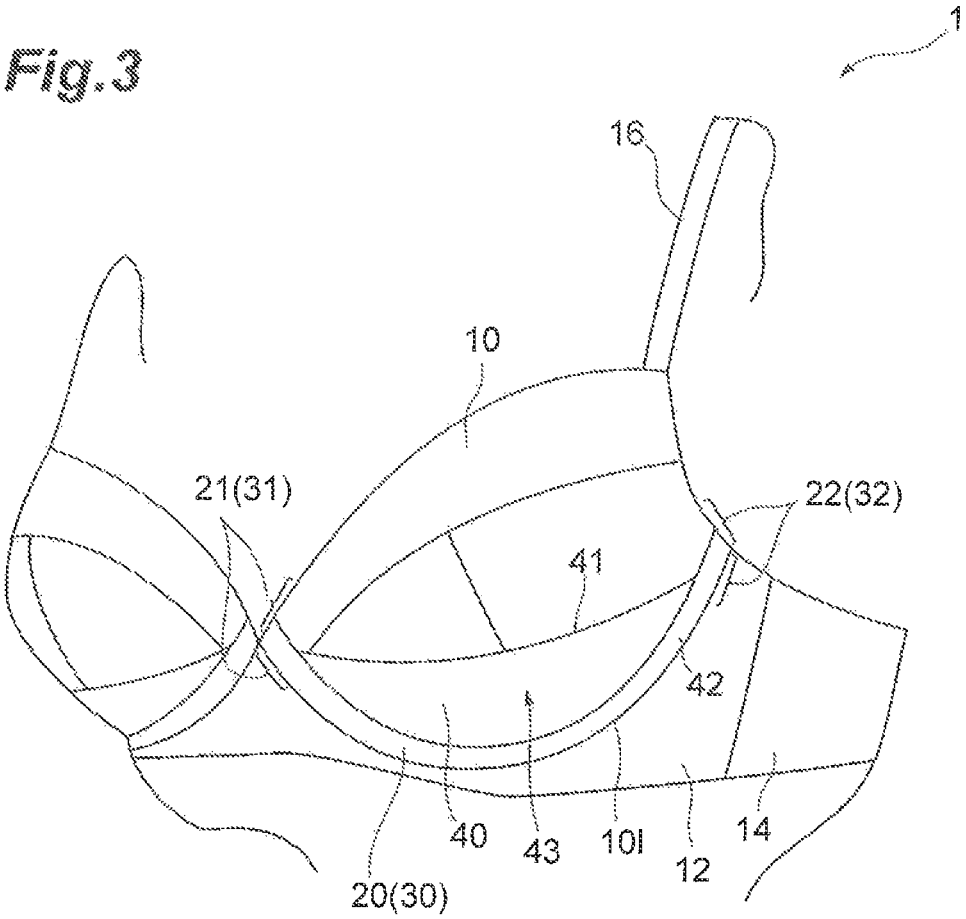
FIG. 3 is a perspective view showing a brassiere according to a modification example of the first embodiment.
Figure 4:
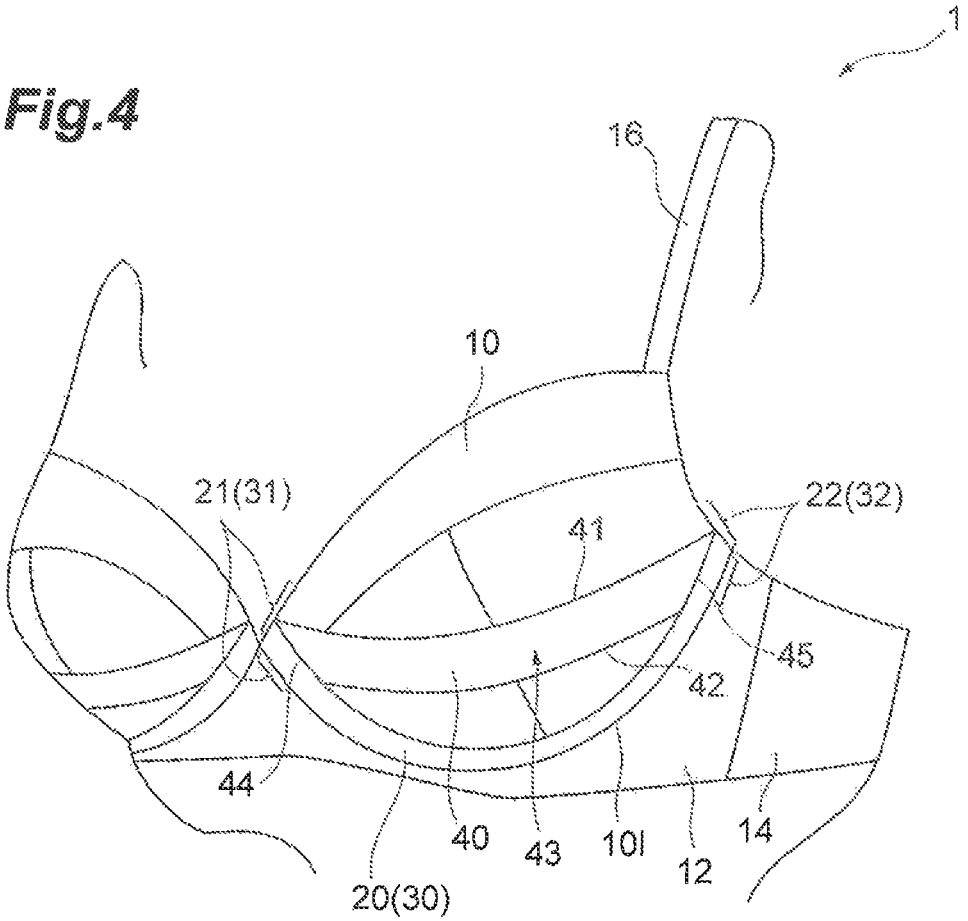
FIG. 4 is a perspective view showing a brassiere according to a modification example of the first embodiment.

FIGS. 2 to 4 are drawings showing the brassieres of modification examples of the first embodiment. As shown in FIG. 2, the upper edge 41 of the expansion suppressing part 40 may be located at a higher position than in the first embodiment. In this modification example, the upper edge 41 of the expansion suppressing part 40 is also located on the shortest line connecting the front center end 21 and the side end 22 of the lower edge portion 20, on the front surface of the cup part 10. In other words, the upper edge 41 of the expansion suppressing part 40 is located on the shortest line connecting the front center end 31 and the side end 32 of the cup wire 30, on the front surface of the cup part 10. In this modification example, a front center edge 44 and a side edge 45 of the expansion suppressing part 40 are also sewn to the cup part 10. In this modification example, the expansion of the lower edge portion 20 and the cup wire 30 can also be suppressed by the expansion suppressing part 40.

Furthermore, as shown in FIG. 3, the upper edge 41 of the expansion suppressing part 40 may be located at a lower position than in the first embodiment. In this modification example, the upper edge 41 of the expansion suppressing part 40 is also located on the shortest line connecting the front center end 21 and the side end 22 of the lower edge portion 20, on the front surface of the cup part 10. In other words, the upper edge 41 of the expansion suppressing part 40 is located on the shortest line connecting the front center end 31 and the side end 32 of the cup wire 30, on the front surface of the cup part 10. In this modification example, the expansion of the lower edge portion 20 and the cup wire 30 can also be suppressed by the expansion suppressing part 40.

Moreover, as shown in FIG. 4, the lower edge 42 of the expansion suppressing part 40 may be located at a higher position than in the first embodiment. Namely, the expansion suppressing part 40 may be of a belt-like shape. Specifically, the upper edge 41 and lower edge 42 of the expansion suppressing part 40 are located on the shortest line connecting the front center end 21 and the side end 22 of the lower edge portion 20, on the front surface of the cup part 10. In other words, the upper edge 41 and lower edge 42 of the expansion suppressing part 40 are located on the shortest line connecting the front center end 31 and the side end 32 of the cup wire 30, on the front surface of the cup part 10. In this modification example, the front center edge 44 of the expansion suppressing part 40 is sewn to the front center end 21 of the lower edge portion 20, the side edge 45 of the expansion suppressing part 40 is sewn to the side end 22 of the lower edge portion 20, and the other portion of the expansion suppressing part 40 is not sewn. In this modification example, the expansion of the lower edge portion 20 and the cup wire 30 can also be suppressed by the expansion suppressing part 40.

[Second Embodiment]

Figure 5:
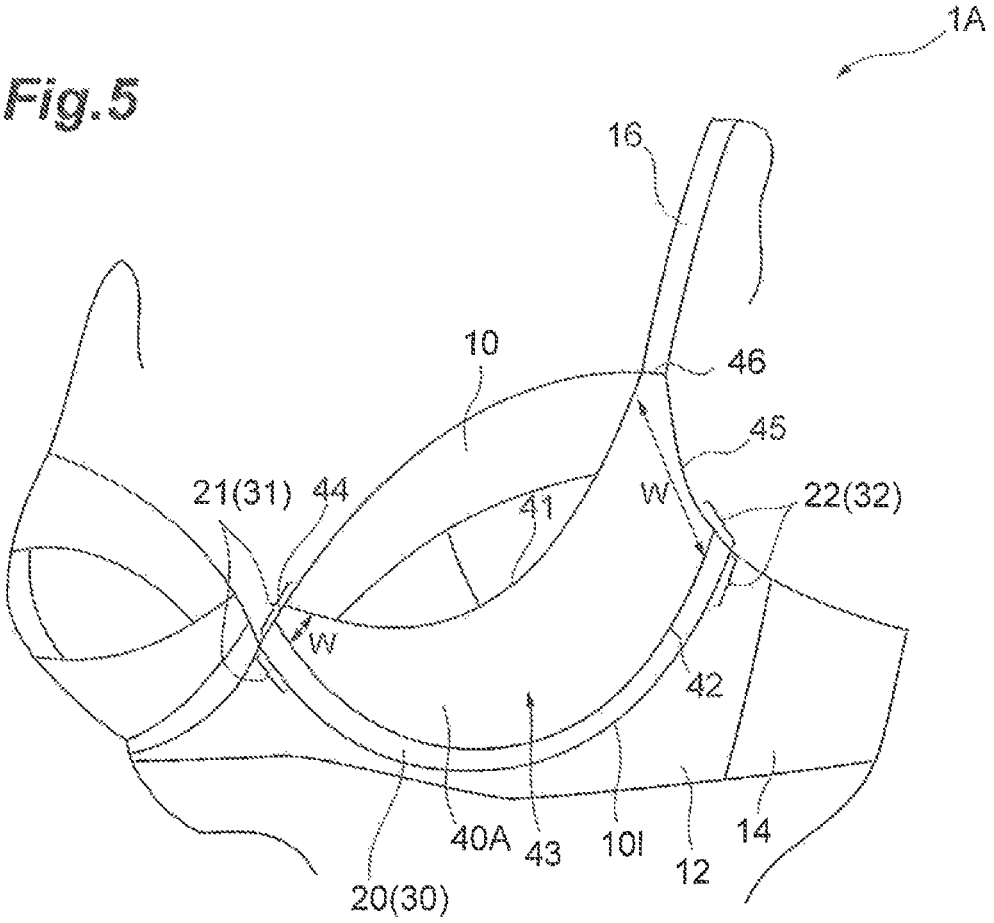
FIG. 5 is a perspective view showing a brassiere according to the second embodiment of the present invention.

FIG. 5 is a perspective view showing the brassiere according to the second embodiment of the present invention. The brassiere 1A of the second embodiment is different in a configuration with expansion suppressing parts 40A instead of the expansion suppressing parts 40 in the brassiere 1 from the first embodiment. The other configuration of the brassiere 1A is the same as that of the brassiere 1.

The expansion suppressing part 40A is formed so that the vertical width gradually increases from the front center area to the side area, and it extends from the front center end 21 of the lower edge portion 20 to the side end 22 of the lower edge portion 20 and to the side area of the upper edge of the cup part 10, along the front surface of the cup part 10. In other words, the expansion suppressing part 40A extends from the front center end 31 of the cup wire 30 to the side end 32 of the cup wire 30 and to the side area of the upper edge of the cup part 10.

The lower edge 42, front center edge 44, and side edges 45, 46 except for the upper edge 41 of the expansion suppressing part 40A are sewn to the cup part 10, and the other portion of the expansion suppressing part 40A is not sewn to the cup part 10. The expansion suppressing part 40A is comprised of the same member as the expansion suppressing part 40 is.

The brassiere 1A of this second embodiment can also have the same advantage as the brassiere 1 of the first embodiment. Furthermore, the brassiere 1A of the second embodiment has the expansion suppressing part 40A which acts to lift the breast by making use of the pull-up force of the strap part 16, thereby further enhancing the breast shaping capability.

The present invention can be modified in many ways without having to be limited to the above-described embodiments of the invention. For example, the embodiments of the invention showed the brassieres with the cup wires 30 by way of illustration, but the features of the present invention can also be applicable to the brassieres of the non-wire type with no cup wires. For example, it is apparent that in the non-wire type brassieres the tensile strength necessary for expanding the lower edge portion by 1 cm is also small, not more than 150 cN, and thus they can also enjoy the same advantage as that of the embodiments.

The embodiments showed the brassieres in which the expansion suppressing part 40 or 40A extended along the front surface of the cup part 10, by way of illustration, but the expansion suppressing part 40, 40A may extend along the back surface of the cup part 10.

In the embodiments, the expansion suppressing part 40, 40A was provided in the form of a patch on the front surface of the lower part of the T-shaped three-piece joint cup part 10, but it may be formed in a joint structure in which the cup part is made of two or more materials with different characteristics and the expansion suppressing part is integrated with the lower member of the cup part.

In the embodiments, the strap part 16 was sewn to the side area of the upper edge of the cup part 10, but the strap part may be detachably engaged with the side area of the upper edge of the cup part 10 through an engagement member such as a Z hook & eye clasp.

The embodiments showed the brassieres of a type in which the rear ends of the back parts 14 were joined together through a hook or the like, by way of illustration, but the features of the embodiments can also be applicable to the brassieres of a front hook type in which the base part 12 is cut into right and left pieces at the front center and the right and left pieces are joined together through a hook or the like.

The features of the embodiments can also be applicable to brassieres of all types including full-cup brassieres, ¾ cup brassieres, and half-cup brassieres.

The features of the embodiments can also be applicable to all clothing articles as long as they have cup parts, e.g., bra-slips, bra-camisoles, body suits, teddies with cups, and swimming suits, besides the brassieres.

[Example 1]

The brassieres 1A of the embodiment of the present invention shown in FIG. 5 were produced as Example and evaluated by seventeen 17- to 24-year-old monitors (in varioussizes from B70 to D70). In this evaluation, Example was evaluated in comparison with conventional products.

The conventional products used for the comparison with Example are other firm's products each of which is favored by women in their late teens to twenties. The features and specifications of these conventional products are as follows.

Conventional Product A: a brassiere of a type which offers both of good wear comfort and high breast shaping capability and which relatively gives priority to the wear comfort between the foregoing features.

Conventional Product B: a brassiere of a type which offers both of good wear comfort and high breast shaping capability and which relatively gives priority to the breast shaping capability between the foregoing features.

The cup wire characteristics and the presence/absence of the expansion suppressing parts of Example and the conventional products are as described below.

Example: uses resin wires. The tensile strength necessary for expanding the wires by 1 cm is about 75 cN.

Conventional Product A: uses soft metal wires. The tensile strength necessary for expanding the wires by 1 cm is smaller than about 350 cN, which is that of the metal wires used in ordinary brassieres. It has no expansion suppressing parts.

Conventional Product B: uses metal wires. The tensile strength necessary for expanding the wires by 1 cm is about 164 cN. It has no expansion suppressing parts.

(Evaluation 1)

In this evaluation, each monitor was asked, "Which do you feel superior between Example of the present invention and Conventional Product A." The result of this evaluation is provided in Table 1. In Table 1, circle marks indicate answers of superiority of Example of the present invention, triangle marks answers of about the same, and cross marks answers of superiority of the conventional product. This evaluation result was obtained after action in a large range of motion simulating active scenes.

It should be noted herein that, among women in their late teens to twenties, the percentage of a wear comfort preference group with significance on wear comfort is lower than the percentage of a shaping preference group with significance on the breast shaping capability as a function of the brassiere. Therefore, the evaluation result is presented as classified into the wear comfort preference group and the shaping preference group.

TABLE 1

| | Wear Comfort Preference Group | Shaping Preference Group | Total |
|---|---|---|---|
| Preference of wear comfort | ○ 3 | ○ 2 | ○ 5 |
| | ∇ 3 | ∇ 4 | ∇ 7 |
| | x 4 | x 1 | x 5 |
| Preference of following capability to motion | ○ 4 | ○ 5 | ○ 9 |
| | ∇ 3 | ∇ 1 | ∇ 4 |
| | x 3 | x 1 | x 4 |
| Preference of shaping capability | ○ 7 | ○ 6 | ○ 13 |
| | ∇ 2 | ∇ 1 | ∇ 3 |
| | x 1 | x 0 | x 1 |
| Choice for wearing | ○ 6 | ○ 6 | ○ 12 |
| | ∇ 1 | ∇ 0 | ∇ 1 |
| | x 3 | x 1 | x 4 |

According to this evaluation result, Example showed approximately the same result as Conventional Product A with significance on the wear comfort, as to the wear comfort and following capability to motion. It should be noted herein as to this preference that more women felt Example better in shaping capability than Conventional Product A, while Example was highly evaluated not only by the wear comfort preference group but also by the shaping preference group.

(Evaluation 2)

Figure 6:
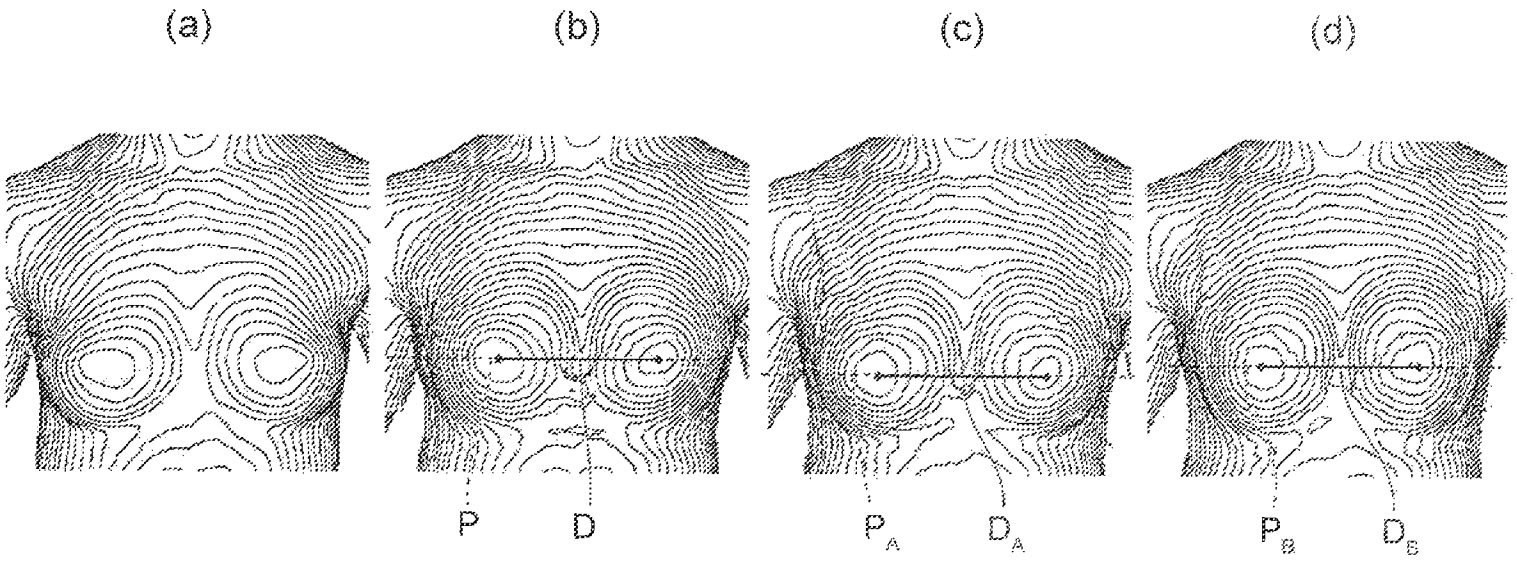
FIG. 6 (*a*) to (*d*) are drawings showing the moiré contour analysis results as front views of the breasts (a) in a nude state, (b) in a wearing state of the embodiment of the invention, (c) in a wearing state of a first comparative example, and (d) in a wearing state of a second comparative example, respectively.
Figure 7:
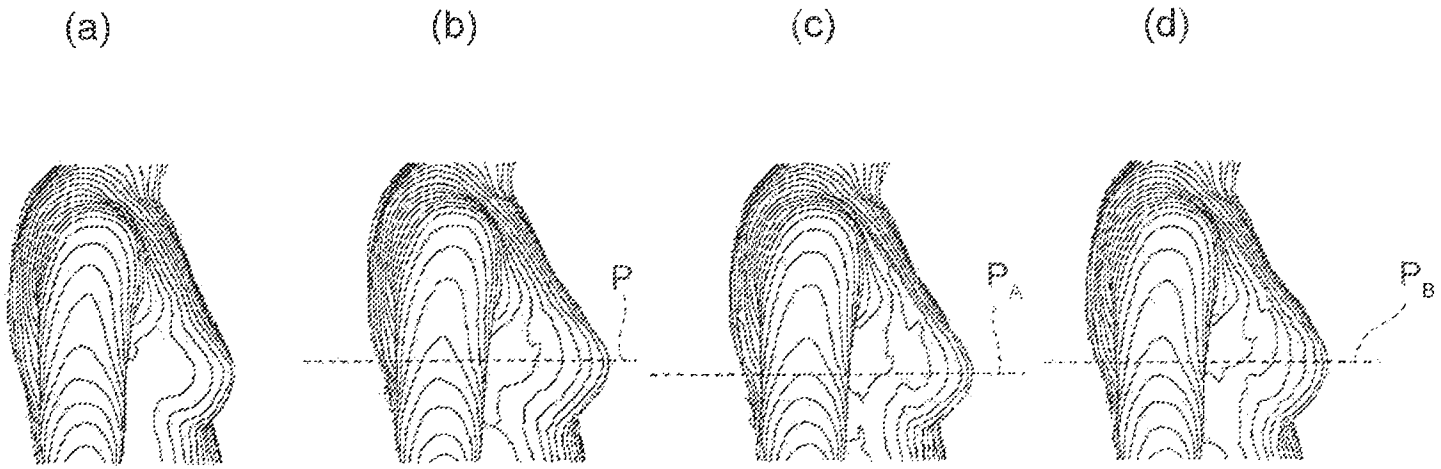
FIG. 7 (*a*) to (*d*) are drawings showing the moiré contour analysis results as side views of the breasts (a) in the nude state, (b) in the wearing state of the embodiment of the invention, (c) in the wearing state of the first comparative example, and (d) in the wearing state of the second comparative example, respectively.

In this evaluation, the breasts were photographed while a woman was wearing the brassieres of Example of the present invention and each of the comparative examples and thereafter the moiré contour analysis was conducted for each of the cases. The analysis results of these are shown in FIGS. 6 and 7. FIG. 6 is the drawings showing the moiré contour analysis results as front views of the breasts (a) in a nude state, (b) in a wearing state of the embodiment of the invention, (c) in a wearing state of the first comparative example, and (d) in a wearing state of the second comparative example and FIG. 7 the drawings showing the moiré contour analysis results as side views of the breasts (a) in the nude state, (b) in the wearing state of the embodiment of the invention, (c) in the wearing state of the first comparative example, and (d) in the wearing state of the second comparative example.

According to the evaluation results, it is seen that the nipple position P in the wearing state of Example of the present invention is higher than the nipple position $P_A$ in the wearing state of Conventional Product A with significance on the wear comfort and equivalent to the nipple position $P_B$ in the wearing state of Conventional Product B with significance on the breast shaping capability. In addition, the nipple-nipple distance D in the wearing state of Example of the present invention is smaller than the nipple-nipple distance $D_A$ in the wearing state of Conventional Product A (i.e., the nipples are located closer than with Conventional Product A) and equivalent to the nipple-nipple distance $D_B$ in the wearing state of Conventional Product B.

It is understood from the above that Example of the present invention can achieve the satisfactory wear comfort and following capability to motion equivalent to those of Conventional Product A with significance on the wear comfort (Evaluation 1) and can also achieve the breast shaping capability equivalent to that of Conventional Product B with significance on the breast shaping capability (Evaluation 2).

These evaluation results will be accepted by women across all age groups, without being limited only to the 17- to 24-year-old women, and the features of the present invention are applicable to the clothing articles with cup parts for all age groups.

INDUSTRIAL APPLICABILITY

The present invention is applicable to usage as clothing articles with cup parts capable of achieving satisfactory wear comfort, high following capability to wearer's motion, and high breast shaping capability.

REFERENCE SIGNS LIST

1, 1A brassiere; 10 cup part; 12 base part; 14 back part; 16 strap part; 20 cup hollow part; 21 front center end of cup hollow part; 22 side end of cup hollow part; 30 cup wire; 31 front center end of cup wire; 32 side end of cup wire; 40, 40A expansion suppressing part.

The invention claimed is:

1. A clothing article having cup parts for covering breasts, comprising:

lower edge portions each of which is provided along a lower edge of the cup part and has a curved shape, each lower edge portion having a tensile strength of not more than 150 cN for expanding a space by 1 cm between a front center extremity and a side extremity of the curved shape against a retaining force of the lower edge portion of the curved shape; and expansion suppressing parts each of which extends from a front center end to a side end of the lower edge portion along a front surface of the cup part in a lower part of the cup part, each expansion suppressing part being connected to the front center end and to the side end of the lower edge part, and having a non-stretchable characteristic suppressing expansion of the space between the front center extremity and the side extremity of the lower edge portion.

2. The clothing article having the cup parts according to claim 1, wherein the expansion suppressing part has a front center area, a side area, and a vertical width, wherein the vertical width gradually increases from the front center area to the side area of the suppressing part, and extends from the front center end of the lower edge portion to the side end of the lower edge portion and to a side area of an upper edge of the cup part.

3. The clothing article having the cup parts according to claim 1, wherein the lower edge portion is fitted with a cup wire, wherein the cup wire has a curved shape, and wherein a tensile strength of the cup wire for expanding the space between the front center extremity and the side extremity of the curved shape by 1 cm against the retaining force of the lower edge portion of the curved shape is not more than 150 cN.

4. The clothing article having the cup parts according to claim 3, wherein the cup wire is comprised of a resin material.

* * * * *